United States Patent [19]

Arita et al.

[11] Patent Number: 5,019,603

[45] Date of Patent: May 28, 1991

[54] PROCESS FOR THE PRODUCTION OF POROUS PHENOLIC RESIN FIBERS

[75] Inventors: Yoshikazu Arita, Takasaki; Yukio Abe, Maebashi; Toshi Iizuka, Takasaki; Yoshio Nakamura; Shoji Takigami, both of Kiryu; Machiko Takigami, Kiryu, all of Japan

[73] Assignee: Gunei Kagaku Kogyo Kabushiki Kaisha, Japan

[21] Appl. No.: 457,528

[22] Filed: Dec. 27, 1989

[30] Foreign Application Priority Data

Mar. 20, 1989 [JP] Japan ..... 1-68240

[51] Int. Cl.[5] ..... C08J 9/38

[52] U.S. Cl. ..... 521/181; 521/131; 525/502

[58] Field of Search ..... 521/181, 131; 525/502

[56] References Cited

U.S. PATENT DOCUMENTS

| | | | |
|---|---|---|---|
| 4,018,725 | 4/1977 | Hadley | 525/502 |
| 4,173,598 | 11/1979 | Castelazo et al. | 525/243 |
| 4,350,776 | 9/1982 | Smith | 521/136 |
| 4,593,070 | 6/1986 | Oyama et al. | 525/502 |
| 4,764,535 | 8/1988 | Leicht | 521/91 |

*Primary Examiner*—John Kight, III
*Assistant Examiner*—John M. Cooney
*Attorney, Agent, or Firm*—Lorusso & Loud

[57] ABSTRACT

A process for the production of porous phenolic resin fibers is disclosed, which process comprises graft-polymerizing to phenolic resin fibers a vinyl group-containing monomer capable of forming a thermally decomposable polymer, and thereafter subjecting the fibers to a heat treatment at a temperature high enough to cause thermal decomposition of the graft polymer. The product thus obtained is excellent in heat-resistance and adiabatic property in addition to useful properties inherent to phenolic resin fibers.

10 Claims, No Drawings

PROCESS FOR THE PRODUCTION OF POROUS PHENOLIC RESIN FIBERS

BACKGROUND OF THE INVENTION

1. Field of the Invention

The present invention relates to a process for the production of porous phenolic resin fiber and a porous fibrous structure made of phenolic resin possessing excellent heat-resistance and adiabatic property in addition to high flexibility.

2. Description of the Prior Art

The phenolic resin fibers are generally produced in such manner that a thermoplastic resin called phenolic novolac which has been obtained by condensing at least one phenol compound with an aldehyde compound represented by formaldehyde in the presence of an acidic catalyst is molten in a non-oxidative atmosphere by heating and then subjected to a crosslinking reaction with an aldehyde compound such as formaldehyde under various reaction conditions including the use of a basic or acidic catalyst or the use of a basic catalyst followed by an acidic catalyst (See, for example, Japanese Patent Publn. No. Sho.48-11284).

From the past, phenolic resin fibers are used as a material for various kinds of safety goods in case of emergency, adiabatic materials, packing of sealing materials and a substitute for asbestos, utilizing their good heat-resistance, adiabatic property, and chemicals-resistance based on their molecular structure. As the phenolic resin fibers show a good yield of a product on carbonization and are excellent in physical properties when processed to active carbon fibers, the phenolic resin fibers are useful also as a precursor of carbon fibers or active carbon fibers.

However, phenolic resin fibers as organic fibers are not comparable, even if they possess excellent heat-resisting property, with inorganic fibers such as glass fibers or ceramic fibers in heat-resisting temperature, and so may not be used under severe conditions. Thus, a number of studies have been made from the past for improving various properties of the phenolic resin fibers.

In Japanese Laid-open Patent Appln. No. Sho. 53-94626, there is disclosed under the title "a process for manufacturing flame-resisting fiber or flame-resisting fibrous structure" an economical process for the production of flame-resisting fibers possessing excellent heat-resistance, which is characterized by bringing phenolic resin fibers in a non-oxidative atmosphere to a heat-treatment conducted at 280–400° C. under relaxative conditions for the fibers. In Japanese Patent Publn. No. Sho. 50-34125, there is disclosed under the title "infusible, non-combustible hollow fibers and a process for producing same" a process for the production of infusible, non-combustible hollow fibers which are excellent in bending strength, chemical-resistance and adiabatic property characterized by crosslinking uncured phenolic resin fibers inwardly from the outer peripheral portion thereof up to a depth of 20–90 % of the cross-sectional area thereof and then extracting the uncrosslinked portion of the resin in the central part of the fibers with a solvent.

In case attention is paid particularly to heat-resisting and adiabatic properties of the fibers, however, the phenolic resin fibers obtained in the above mentioned prior art processes are still unsatisfactory in these properties; heat-resistance is certainly improved but adiabatic property is not improved in case of the solid fibers and adiabatic property is certainly improved but heat resistance is not improved in case of hollow fibers, while adiabatic property is improved but the field of industry producing or using frictional materials, adiabatic materials, packing/sealing materials and safety goods, improvement in heat-resistance and adiabatic property of the product is always required to warrant the performance of the product under severe conditions. Under the circumstance, there is a great demand for developing a new process for producing phenolic resin fibers which are remarkably improved in heat-resistance and adiabatic property without damaging their other useful properties such as chemical-resisting property, infusibility and flexibility as fibers.

BRIEF SUMMARY OF THE INVENTION

Accordingly, it is an object of the present invention to provide a new process for the production of porous phenolic resin fibers and a porous fibrous structure made of phenolic resin possessing excellent useful properties.

It is another object of the present invention to provide a process for the production of porous phenolic resin fibers and a porous fibrous structures made of phenolic resin improved remarkably in heat-resistance and adiabatic property thereof without damaging other useful properties inherent to phenolic resin.

It is still another object of the present invention to provide a new means for making the phenolic resin fibers or the porous fibrous structure by incorporating therewith a thermally decomposable polymer by graft polymerization and then heating the fibers for decomposing the polymer.

Other and further objects, features and advantages of the present invention will be apparent more fully from the following description.

DETAILED DESCRIPTION OF THE INVENTION

Taking the above mentioned circumstances into consideration, the present inventors have extensible researches to attain these objects. As a result of the extensive researches, it has now been found that a monomer containing a vinyl group capable of producing a thermally decomposable polymer is incorporated into phenolic resin fibers or a fibrous structure made of phenolic resin by graft polymerization and the fibers or fibrous structure is subjected to a heat treatment at a temperature high enough to initiate thermal decomposition of the grafted polymer, whereby the incorporated polymer is eliminated to form porous fibers or fibrous structure which are/is improved remarkably in heat-resistance and adiabatic property without damaging other useful properties inherent to phenolic resin, such as chemical-resistance, infusibility and flexibility as fibers. The present invention has been accomplished on the basis of the above finding.

In accordance with the present invention, there is provided a process for the production of porous phenolic resin fibers or a porous fibrous structure made of phenolic resin, which comprises graft polymerizing to the fibers or fibrous structure a vinyl group-containing monomer capable of forming a thermally decomposable polymer in an amount corresponding to a grafting rate of 5–100% and thereafter subjecting the fibers or fibrous structure to a heat treatment at a temperature high enough to cause thermal decomposition of the graft polymer.

The present invention has various features as compared with the prior art processes. First of all, the product obtained has a porous structure so that the heat-resistance and adiabatic property of the product are remarkably improved without damaging other useful properties inherent to phenolic resin. Secondly, such porous structure is formed by once incorporating a thermally decomposable vinyl compound into the fibers or fibrous structure by graft polymerization and then subjecting the fibers or fibrous structure to a heat treatment conducted at a temperature high enough to cause thermal decomposition of the graft polymer. The sort of the monomer and a proportion thereof and the temperature in the heat treatment are suitably selected according to the conditions employed.

The phenolic resin fibers or a fibrous material made of the phenolic resin used in the process of this invention can be manufactured according to any of the known conventional processes as disclosed in the above mentioned publication. The fibrous structure made of phenolic resin may be in any of the forms such as textile materials like cloth, tubes, nets, ropes, gasket, etc.

The vinyl group-containing monomer used in the process of this invention should form a homopolymer which is thermally decomposable at a temperature preferably up to 300° C. Vinyl monomers generally used in the field of polymer industry are included in the vinyl group-containing monomer. Illustrative of such vinyl group-containing monomer are, for example, $C_1$–$C_8$ alkyl acrylates or methacrylates such as methyl acrylate, methyl methacrylate, ethyl acrylate, ethyl methacylate, propyl acrylate, propyl methacrylate, butyl acrylate and hexyl methacrylate; acrylonitrile, or methacrylonitrile; vinyl halides such as vinyl chloride; and styrene. The use of methyl acrylate or methyl methacrylate which forms a polymer thermally decomposable at a temperature lower than 300° C. is preferable. The vinyl group-containing monomer is used in an amount corresponding to a grafting rate of 5–100 %.

By the term "graft polymerization" is meant herein a mode of polymerization generally used in the air for expressing the grafting a polymer chain of the monomer to the main chain of a substrate. In general, such graft polymerization can be initiated by irradiating a mixture containing a substrate and a monomer with various actinic rays such as election-rays, X-rays, UV-rays, low temperature plasma, and by using a polymerization initiator well known in this art in a solution system or an emulsion system, whereby radicals for initiation of the polymerization are formed on the surface or in the internal space of the fiber and the graft polymerization takes place according to the chain transfer mode. No limitation exists in the sort of graft polymerization and in the conditions thereof in the present invention. However, the sort of the actinic rays, polymerization initiators, emulsifiers in case of using an emulsion system, temperature of the system is suitably selected according to the intended purpose, since these factors influence greatly on the grafting rate.

By the term "grafting rate" is meant herein the amount in terms of percentage of the monomer incorporated as a polymer thereof into the fibers or fibrous structure as a result of graft polymerization reaction and is calculated according to the following equation:

$$GR = \frac{W_1 - W_0}{W_0} \times 100$$

GR: Grafting rate (%)

$W_0$ Weight of the fibers before the reaction $W_1$ Weight of the fibers after the reaction To obtain a satisfactory result, the grafting rate is preferably within the range of 5–100 %. If the grafting rate is less than 5 %, the porosity of the fibers or fibrous structure obtained after the heat treatment will become insufficient and fail to give satisfactory adiabatic property. On the other hand, if the grafting rate exceeds 100%, the amount of the polymer to be eliminated by the heat treatment will become too much to obtain a desirable porosity so that the yield of the fibers or fibrous structure will be reduced after the heat treatment and the useful properties of the product will be deteriorated.

After completion of the graft polymerization, the fibers or fibrous structure is subjected to a heat treatment which is carried out at a temperature high enough to cause thermal decomposition of the polymer incorporated into the fibers or fibrous structure. The temperature for the heat treatment is usually up to 300° C. If the temperature is too low, the thermal decomposition of the polymer will become insufficient and fall to impart a desired porosity to the fibers or fibrous structure. If the temperature is too high, the fibers or fibrous structure will undergoes thermal deterioration to damage the useful properties. The time required for this heat treatment is usually from 30 minutes to 150 minutes, while the temperature is usually between 150° C. and 300° C., inclusive. In general, a temperature lower than 150° C. is insufficient to obtain a satisfactory porosity desired in the present invention, while a temperature above 300° C. will tend to increase the modulus of elasticity of the resultant fibers or fibrous structure whereby flexibility as fiber will be lost. As a result of the heat treatment, a great number of micropores with a diameter of less than 100 Å A are formed in the fibers or fibrous structure. The phenolic resin fibers are swollen when the graft polymerization of the monomer takes place in the interior of the fibers. When the swollen fibers are subjected to the heat treatment, the graft polymer located in the interior of the fibers is thermally decomposed and eliminated from the interior of the fibers to leave micropores since the fibers once swollen are not shrinked to the original form. The porous phenolic resin fibers or the fibrous structure made of phenolic resin can thus be produced as a result of the graft polymerization followed by the heat treatment.

Prior to the heat treatment, the fibers or fibrous structure may optionally be extracted with an organic solvent to wash out any remaining monomer or lower molecular homopolymer of the monomer in the interior of the fibers or fibrous structure. An example of such organic solvent is acetone.

As the porous phenolic resin fibers or the porous fibrous structure made of phenolic resin thus obtained have/has well developed micropores on the surface of interior thereof, their heat-resistance and adiabatic property are significantly improved without damaging other useful properties such as chemical-resistance, infusibility and flexibility as fibers. Accordingly, the product obtained according to this invention can be used as a material for various kinds of safety good in case of emergency, adiabatic materials, packing/sealing materials and a substitute for asbestos under more severe conditions. In addition, the product obtained by the process of this invention can effectively be carbonized to form porous carbon fibers in a good yield. The resultant carbon fibers having a broad contact area because of their porous structure can be subjected to an activation treatment whereby active carbon fibers having a high specific surface area can be obtained in a high yield. Thus, it is an additional merit of the present invention to use the porous phenolic resin fibers as a precursor of active carbon fibers. In this case, the product of the present invention can indirectly be used in a wide variety of fields including space technology.

The present invention will now be illustrated in more detail by way of examples. The KYNOL TM (trademark of Nippon Kyno, Inc.) fibers used in the working examples are novoloid fibers, which are cured phenol-aldehyde fibers made by acid-catalyzed cross-linking of melt-spun novolac resin to form a fully cross-linked, three-dimensional, amorphous "network" polymer structure similar to that of thermo-setting phenolic resins.

EXAMPLE 1

In a 2-liter separable flask were placed 95 g of methyl methacrylate from which a polymerization inhibitor had been eliminated by active alumina, 4 g of ceric ammonium nitrate, 1.9 g of LT-221 (a non-ionic emulsifier, manufactured by Nihon Yushi KK, Japan) and 1756 g of purified water. The mixture was stirred with a homogenizer to form an emulsion. In this emulsion were dipped 20 g of phenolic resin fibers KR-0204 (trade name: Kynol, manufactured by Gun-ei Kagaku Kogyo KK, Japan), which were then kept for 3 hours at 5° C. while introducing gaseous nitrogen into the emulsion whereby a graft polymerization of the methacrylate monomer took place. The fibers were then taken up from the emulsion and placed in purified water to cease the graft polymerization reaction. Using a Soxhlet extractor, the fibers thus treated was extracted with acetone for 15 hours at 80° C. to eliminate monomer and low molecular homo polymer remaining on the fibers. The fibers were then dried and weighed to calculate a grafting rate in terms of percentage. The grafting rate in this example was 7.2 %. The product thus obtained was subjected to a heat treatment for 30 minutes at 270° C. and cooled naturally whereupon porous phenolic resin fibers were obtained.

EXAMPLE 2

In a mixture of 50 g of methanol and 50 g of methyl methacrylate from which a polymerization inhibitor had been eliminated by active alumina were dipped for 10 minutes 10 g of phenolic resin fibers KR- 0204 (trade name: Kynol manufactured by Gun-ei Kagaku Kogyo KK, Japan). The fibers were then taken up from the mixture, weakly squeezed with a glass rod and irradiated in a nitrogen atmosphere with electronic rays (20 Mrad) for 5 minutes. Using a Soxhlet extractor, the fibers were extracted with acetone for 15 minutes at 80° C. As a result of the extraction, a grafting rate of the fibers in this case was calculated as 21.7%. The fibers were so swollen that their diameter was increased by about 10%. the product thus treated was subjected, as in Example 1, to a heat treatment at 250° C. for 30 minutes and then allowed to stand for natural cooling whereupon porous phenolic resin fibers were obtained.

EXAMPLE 3 (Comparative Example)

In a manner similar to that described in Example 1, 2.2 g of phenolic resin fibers KR-0204 (trade name: Kynol, manufactured by Gun-ei Kagaku Kogyo KK, Japan) were subjected to a heat treatment conducted at 250° C. for 30 minutes to prepare a product for comparison.

The products obtained in Examples 1-3 were subjected under the same conditions to a tension test a result of which is shown in Table 1 below.

TABLE 1

| Example | Tensile strength (g/d) | Tensile elongation (%) | Modulus of elasticity (Kgf/mm$^2$) |
|---|---|---|---|
| 1 | 1.75 | 42 | 487 |
| 2 | 1.60 | 40 | 480 |
| 3 | 1.65 | 43 | 475 |

Table 2 shows a temperature at which reduction in weight is initiated as well as an adiabatic degree as an index of adiabatic property in the TGA measurement of the products obtained in Examples 1-3.

TABLE 2

| Example | Temperature at which reduction in weight is initiated (°C.) | Adiabatic degree (min.) | Specific surface area (m$^2$/g) |
|---|---|---|---|
| 1 | 370 | 72 | 15 |
| 2 | 368 | 156 | 73 |
| 3 | 318 | 39 | 0.9 |

The adiabatic degree in terms of minute was calculated according to the following method: Five grams of the fibers are shaped into a ball of 5 cm in diameter. This ball is then held in an atmosphere maintained at 100° C. and a period of time required until the temperature in the center of the fibrous ball reaches 100° C. In table 2, the specific surface area is a BET specific area by a Flowsorb 2300 Model II (Micro-meritics Inc.) for nitrogen adsorption.

The tabulated results apparently show that porous phenolic resin fibers of a high quality can be obtained according to the present invention, which are remarkably improved in heat-resistance and adiabatic property without damaging their flexibility represented by tensile strength, tensile elongation and modulus of elasticity.

It is understood that the preceding representative examples may be varied within the scope of the present specification both as to the sorts of the monomer and reaction conditions, by those skilled in the art to achieve essentially the same results.

As many widely different embodiments of this invention may be made without departing from the spirit and scope thereof, it is to be construed that this invention is not limited to the specific embodiments thereof except as defined in the appended claims.

What is claimed is:

1. A process for the production of porous phenolic resin fibers, comprising the steps of:

providing phenolic resin fibers;

graft-polymerizing to the phenolic resin fibers a vinyl group-containing monomer to form a graft polymer linked to the phenolic resin fibers, and heating the resulting phenolic resin fibers having the graft polymer linked thereto at a temperature of 150–300 ° C. to thermally decompose the graft polymer.

2. A process according to claim 1, wherein the vinyl group-containing monomer is capable of forming a homopolymer which is thermally decomposable at a temperature of 300 ° C. or less.

3. A process according to claim 2, wherein the vinyl group-containing monomer is a member selected from the group consisting of alkyl acrylates, alkyl methacrylates, vinyl halides, acrylonitrile and styrene.

4. A process according to claim 2, wherein the vinyl group-containing monomer is methyl methacrylate.

5. A process according to claim 1, wherein said graft-polymerization is performed so as to provide a grafting rate of 5–100%.

6. A process according to claim 1, wherein said graft-polymerization is performed so as to provide a grafting rate of 10–50%.

7. A process according to claim 1, wherein said heating step is performed at a temperature of 180–280 ° C.

8. A process according to claim 1, wherein said heating step is performed in the atmosphere of inert gas such as nitrogen or argon.

9. A process according to claim 1, further comprising treating the phenolic resin fibers having the graft polymer linked thereto with an organic extractant before said heating step to extract unreacted monomer and low molecular weight polymers which are not linked to the phenolic resin fibers.

10. A porous phenolic resin fibers obtained by a process according to claim 1.

* * * * *